US006928786B2

(12) United States Patent
Orozco

(10) Patent No.: US 6,928,786 B2
(45) Date of Patent: Aug. 16, 2005

(54) SEMI-RIGID PROFILE SYSTEM FOR THE CONTINUOUS ASSEMBLY OF AGGLOMERATED BOARDS FOR FURNITURE MANUFACTURING

(76) Inventor: Gavaldon Humberto Orozco, Plaza del Aguila 12, Col. A. Ortiz, CP9020 (MX)

( * ) Notice: Subject to any disclaimer, the term of this patent is extended or adjusted under 35 U.S.C. 154(b) by 69 days.

(21) Appl. No.: 10/290,005

(22) Filed: Nov. 6, 2002

(65) Prior Publication Data

US 2003/0089077 A1 May 15, 2003

(51) Int. Cl.[7] ..... E04C 2/38

(52) U.S. Cl. ..... 52/800.12; 52/730.6; 52/733.3; 52/796.12

(58) Field of Search ..... 52/800.12, 800.16, 52/730.1, 730.6, 731.7, 733.3, 796.12, 797.1; 132/140.1, 140.3, 140.4

(56) References Cited

U.S. PATENT DOCUMENTS

| | | | | | |
|---|---|---|---|---|---|
| 3,315,431 | A | * | 4/1967 | Yake | 52/800.12 |
| 3,452,501 | A | * | 7/1969 | Sickler et al. | 52/798.1 |
| 4,107,897 | A | * | 8/1978 | Ullman, Jr. | 52/800.12 |
| 5,634,306 | A | * | 6/1997 | Riegelman | 52/309.16 |
| 5,802,785 | A | * | 9/1998 | Crook | 52/204.53 |
| 6,505,449 | B1 | * | 1/2003 | Gregori | 52/514 |
| 6,655,106 | B1 | * | 12/2003 | Sucre F. | 52/733.2 |

* cited by examiner

*Primary Examiner*—Brian E. Glessner
*Assistant Examiner*—Basil Katcheves
(74) *Attorney, Agent, or Firm*—Carmen Pili Ekstrom

(57) ABSTRACT

A semi-rigid profile system for the continuous assembly of agglomerated board for the manufacturing of pieces of furniture such as closets, wardrobes, chest of drawers, or racks, including: a group of trough shaped profiles with variously shaped internal structure to be fastened onto the side edges of normal or reinforced agglomerated boards, characterized because it is embedded into the edges through one single profile structure by means of bending at the ends of the board facilitated by 45° angle cuts.

10 Claims, 6 Drawing Sheets

SEMI-RIGID PROFILE SYSTEM FOR THE CONTINUOUS ASSEMBLY OF AGGLOMERATED BOARDS FOR FURNITURE MANUFACTURING

BACKGROUND OF THE INVENTION

1. Field of the Invention

The instant invention relates to a novel system of semi-rigid plastic profiles for the finishing of the exterior edges of pieces of furniture for the continuous assembly of agglomerated boards for furniture manufacturing, wardrobes, interior part of closets or shelves in general.

2. Previous Art

Several designs are known for the finishing of lateral exterior edges of pieces of furniture, wardrobes, shelves, cupboards and suitcase racks, either through the application of moldings, lacquer, thermoformed elements or plastic and metal profiles.

In Mexican Patent Application No. 9503436, owned by the applicant of the instant invention, several national and U.S. patents are described as background of the structured profile system for the assembly of agglomerated boards for the manufacturing of pieces of furniture.

In the previous invention, a structured profile type is described which is placed and fastened onto a board by means of a grooved slide. Said invention is characterized mainly because it links the corners of the edges of the boards through a wrapping frame to give the appearance of continuity, said profile being extruded out of very stiff polymer materials.

The applicant has developed a new structured profile system designed in the shape of a trough made of less rigid materials permitting 90 degrees bends. Said new structured profile system eliminates the need for corner pieces and forms a finishing having a thermoformed appearance for the lateral edges of the boards, furniture drawers or even boards reinforced with metal core for cabinets o suitcase racks.

DESCRIPTION OF THE INVENTION

Hereinafter the invention will be described in combination with the drawings of FIGS. 1 to 8 wherein.

The invention is characterized because it presents an improved system of profiles designed to be embedded and fastened to the grooved slides of the boards for the finishing of the lateral edges of boards for wardrobes, drawers or shelves reinforced with metal profiles for racks supporting a larger weight. It is also characterized because it relates to a system for continuous assembly in the manufacturing of said pieces of furniture. The profile is also characterized because it is semi-rigid and stretched up to a thickness of 1.5 to 2 mm permitting the bending of the board without any risk of rupture.

Figure 1:
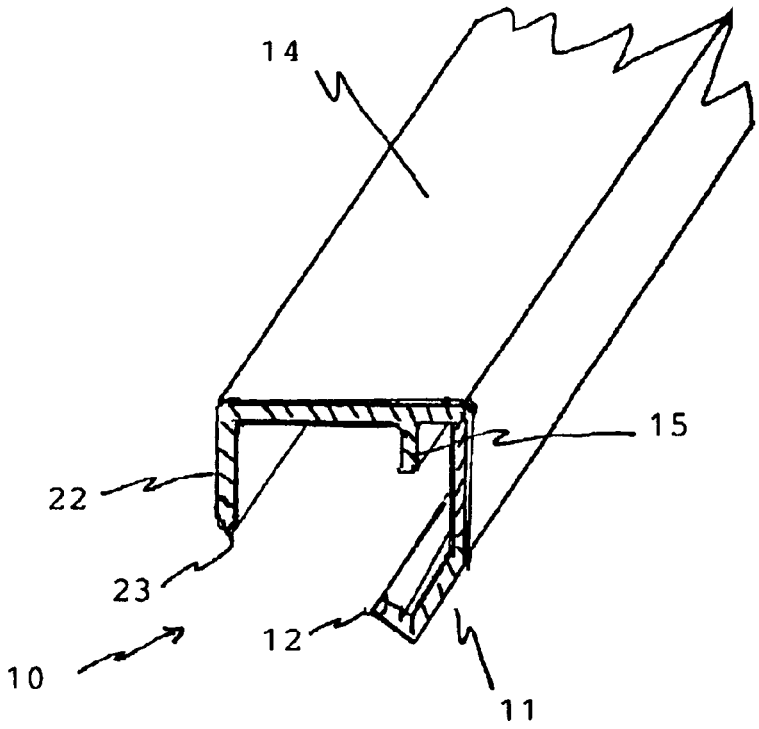
FIG. 1 is a perspective view with a cross section of a flexible profile for furniture board assembly.
Figure 2:
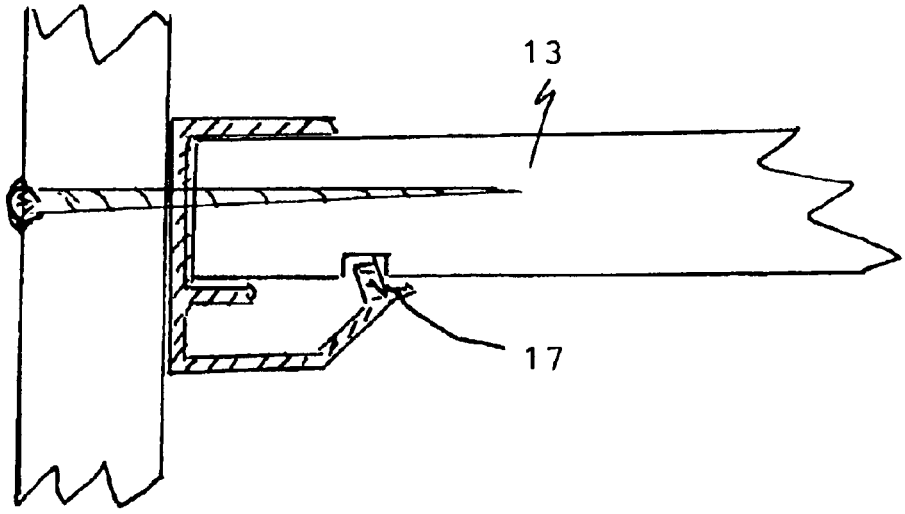
FIG. 2 is a cross-sectional front view of the profile of FIG. 1, applied to a system of furniture board assembly.
Figure 4:
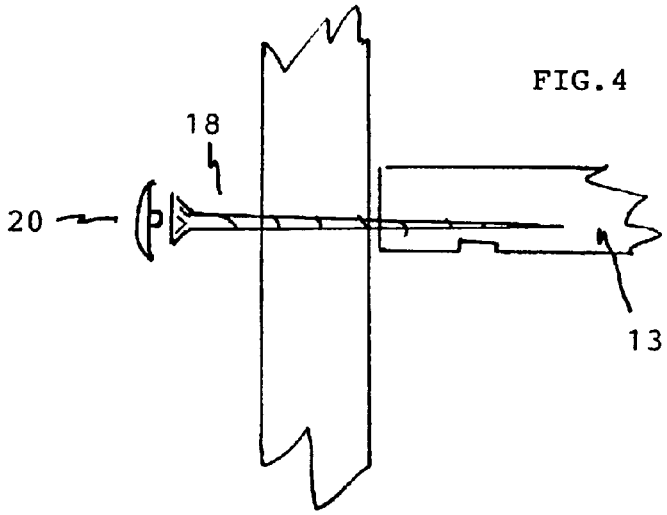
FIG. 4 is a cross-sectional front view of the profile of FIG. 2.

According to FIG. 1, the invention includes a single structured profile 10 extruded in the form of a trough, one of its side ends 11 projecting longitudinally in a "V" shape in the lower part as a fastening element 12 onto the agglomerated board 13, FIGS. 4 and 2. Said board has a longitudinal groove or slit as sliding element 17, FIG. 2, coinciding with the fastening projecting element 12 of profile 10. The profile 10 also has, in the lower part of its upper face 14, a longitudinal flange 15 as compression element for board fastening 13. The surface area of the external faces 14 and 21 is smooth and matches the flat area of the board to give a unitary appearance. The face 22 has a recess 23 in its lower end to apply pressure on the board surface.

Figure 3:
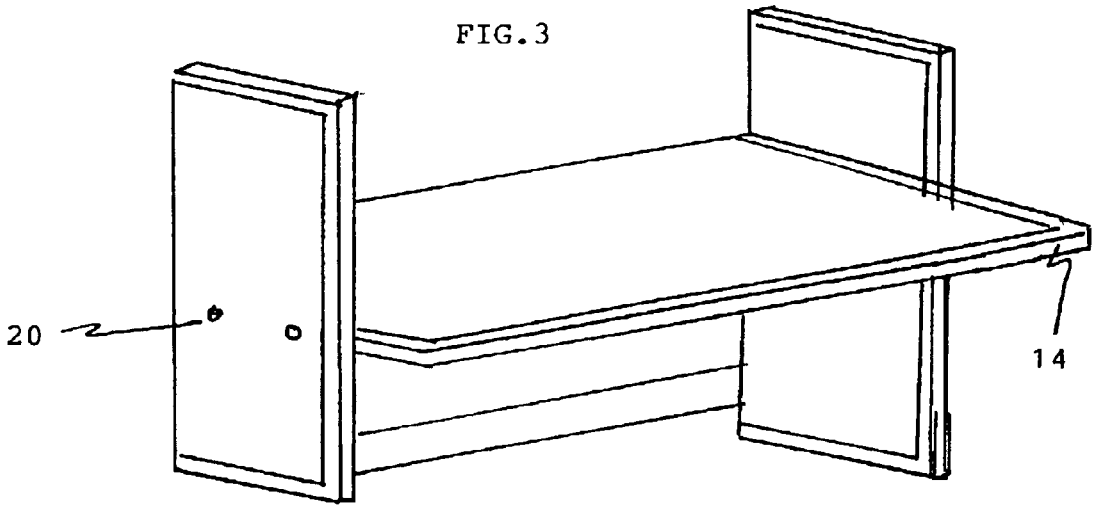
FIG. 3 is a perspective view of the profile assembly system applied to a wardrobe.
Figure 9:
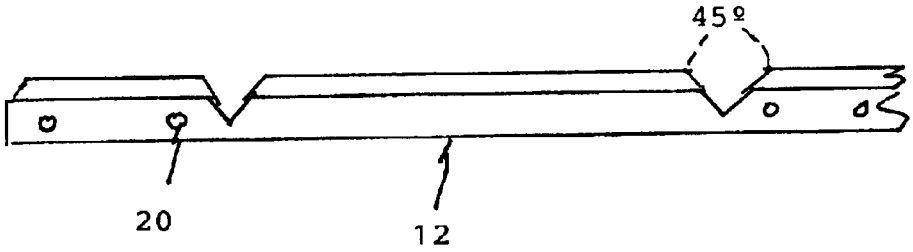
FIG. 9 is an isometric view of the profile with a 45° cross-section.
Figure 10:
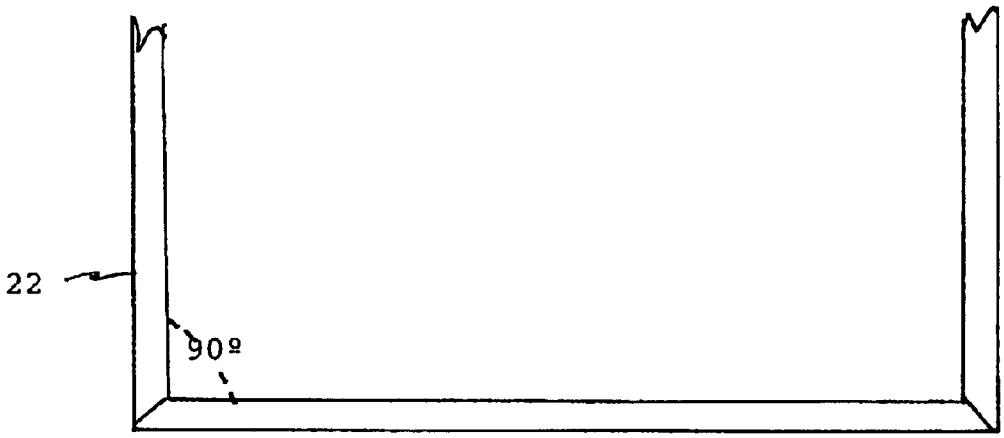
FIG. 10 is a side view of the profile of FIG. 9 with 90° bends.
Figure 11:
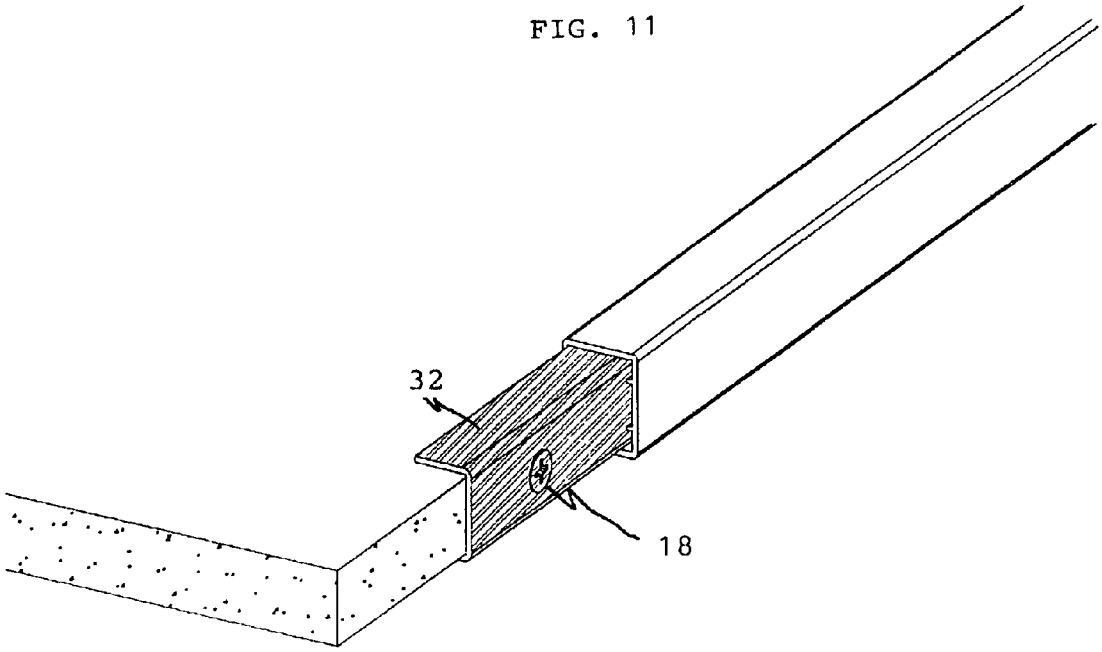
FIG. 11 is a side view of assembled board reinforced of FIG. 8.
Figure 12:
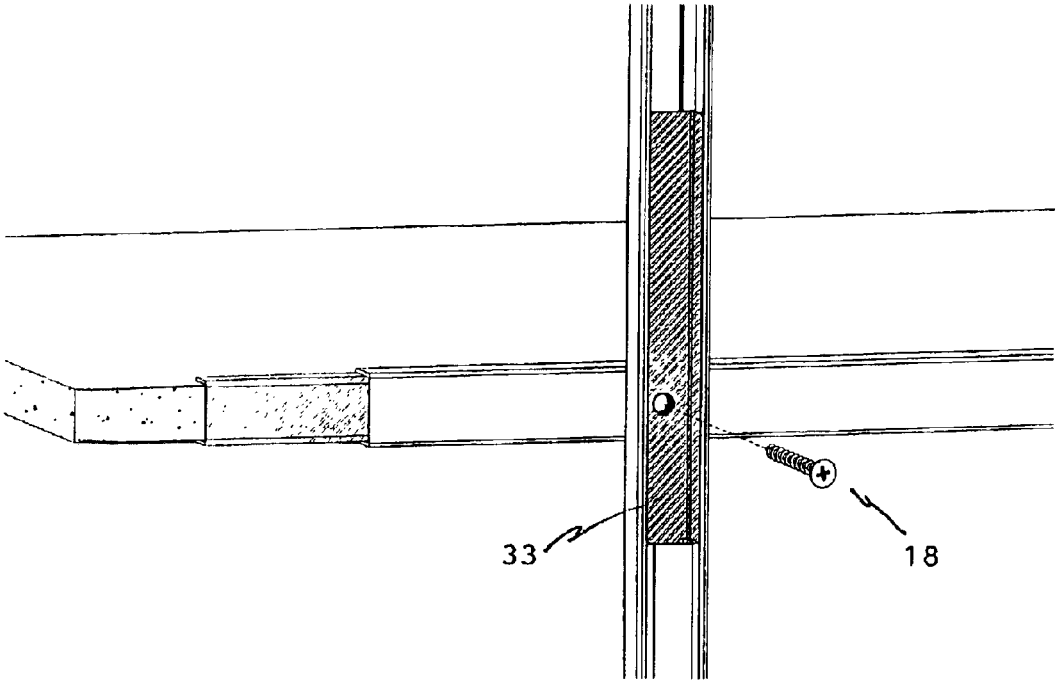
FIG. 12 is a side view vertical of out board support.

The profile 10, FIGS. 9 and 10, is characterized because it is placed on the edges of the board through only one wrapping by means of cuts in its edges 16, FIG. 9, at 45° angles to form one single 95° angle frame, FIG. 10, and assembled as a wardrobe, FIG. 3.

Figure 5:
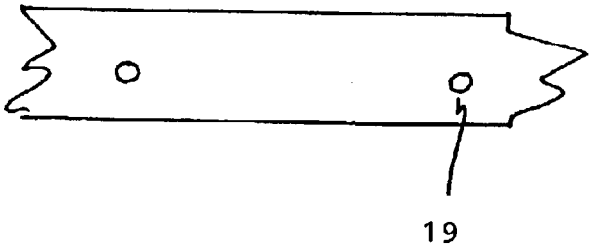
FIG. 5 is a view of the board of FIG. 4.
Figure 6:
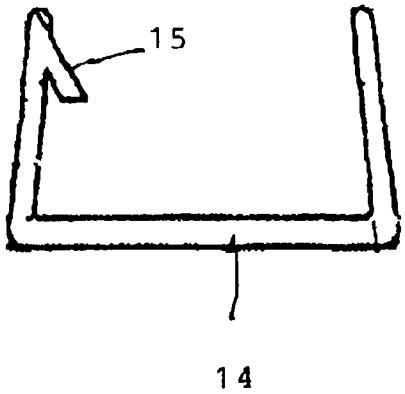
FIG. 6 is a cross-sectional view of the profile structured for drawer edges.
Figure 7:
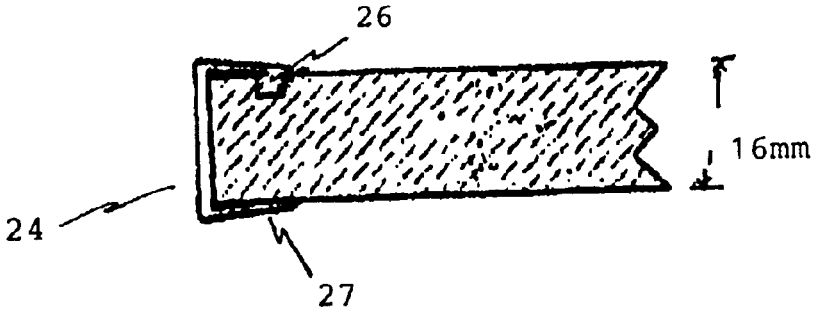
FIG. 7 is a side view of the assembled board of FIG. 6.

The assembly system of the boards according to FIGS. 2, 4 and 5 is through screws 18 and with screwing guides 19 to ensure a tight fastening. Once the boards are screwed, the guides are covered with plugs 20 to cover the hollow spaces. According to FIG. 6, the profile 24 extruded in a "U" shape for drawers, FIGS. 7 and 8, of pieces of furniture or wardrobes, presents, at one of its side ends, a longitudinal prolongation that finishes in an inverted "Y" shape 25, FIGS. 6 and 7, as a fastening element coinciding with a groove 26 in the board. The opposite side 27 does not have a projection. This profile does not have a projecting extruded flange. Its main characteristic is that its front and rear ends 26 and 27 are extruded with a 95 degrees slope and its application onto the edges of the drawer is also through bends at the corners and its assembly is also by means of screw fastening.

Figure 8:
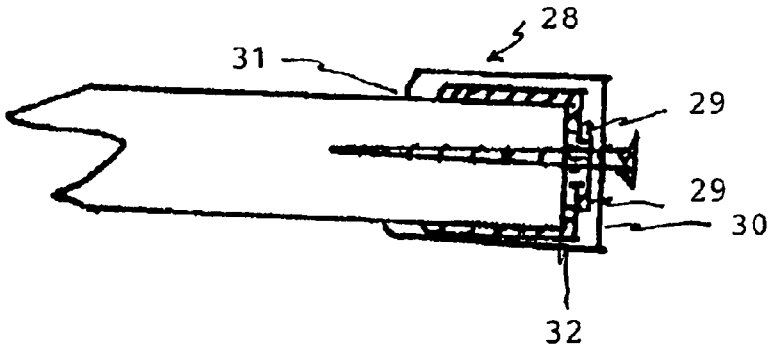
FIG. 8 is a cross-sectional view of a profile applied to a board reinforced with a metal core.

In FIG. 8, the extruded profile 28 in "U" shape consists of two flanges 29 placed equidistantly in the interior part of the upper face 30. The lower ends 31 of the side faces finish in a longitudinal flange as fastening element placed on the reinforcing metal core 32 of the boards of shelves or suitcase racks. Its assembly system is also by means of screw fastening with screwing guides. The assembly system also has additional fastening elements such as lugs, plastic corner pieces, or tongued and grooved couplings.

The assembly system of the boards is through screws 18, and it is covered by a profile 24.

The above-described arrangements are only illustrative of the application of the principles of the present invention. Numerous modifications and alternative arrangements may be devised by those skilled in the art without departing from the spirit ands scope of the present invention. The appended claims are intended to cover such modifications and arrangements.

What is claimed is:

1. A semi-rigid profile system for the continuous assembly of agglomerated boards for manufacturing pieces of furniture, comprising:

a group of trough shaped profiles with variously shaped internal structure for fastening onto the side edges of normal or reinforced agglomerated boards, wherein the profile for the boards for the interior part of closets or wardrobes is an extruded structure having in its interior end a "V" shaped longitudinal prolongation as a fastening element coinciding with a grooved slide longitudinally placed in the agglomerated board, the profile system having only one profile structure embedded in the edges by bending at the ends of the board, said profile structure including also, in the internal structure of the upper face, a longitudinal flange as compression element for fastening the board formed as an integrated unitary piece;

wherein the profile system is assembled through additional fastening elements which are fastened by means of screws and having a series of screwing guides located in non-visible places, said guides being protected by plugs to cover screw hollow spaces.

2. The profile system of claim 1, wherein the pieces of furniture are closets, wardrobes, chest of drawers or shelves.

3. The profile system of claim 1, wherein bending of the profile system is facilitated by 45° angled cuts.

4. The profile system of claim 1, wherein said profile for wardrobe boards is capable of being applicable onto 8 to 16 mm thick agglomerated boards and said profile is stretched up to a 1.5 to 2 mm thick film allowing it to bend without breaking.

5. The profile system according to claim 1, wherein the fastening elements are lugs, plastic or metal corner pieces, tongued and grooved couplings or a combination thereof.

6. The flexible profile system for the continuous assembly of agglomerated boards according to claim 1, comprising additionally a vertical out board support to reinforce agglomerated boards.

7. A semi-rigid profile system for the continuous assembly of agglomerated boards for manufacturing pieces of furniture, comprising a group of trough shaped profiles with variously shaped internal structure for fastening onto the side edges of normal or reinforced agglomerated boards, wherein said profile is for boards reinforced with "U" shape metal core for racks, the profile being extruded in a "U" shape with the interior part having a pair of small longitudinal equidistant flanges acting as fastening elements and wherein the side faces of the profile finish with a rib coupled to the board metal core, the profile system having only one profile structure embedded in the edges by bending at the ends of the board.

8. The profile system for the continuous assembly of agglomerated boards according to claim 7, wherein the profile system is assembled through additional fastening elements which are fastened by means of screws and having a series of screwing guides located in non visible places, said guides being protected by plugs to cover the screw hollow spaces.

9. The profile system according to claim 8, wherein the fastening elements are lugs, plastic or metal corner pieces, tongued and grooved couplings or a combination thereof.

10. The flexible profile system for the continuous assembly of agglomerated boards according to claim 7, comprising additionally a vertical out board support to reinforce agglomerated boards.

* * * * *